US006514049B2

(12) United States Patent
Mera et al.

(10) Patent No.: US 6,514,049 B2
(45) Date of Patent: Feb. 4, 2003

(54) COMPRESSOR CONTROL VALVE WITH TWO INDEPENDENTLY OPERATED CHECK VALVES, WHEREIN THE CRANK CHAMBER PRESSURE IS THE CONTROL PRESSURE, AND THE MONITOR PRESSURE IS THE SUCTION PRESSURE

(75) Inventors: Minoru Mera, Kariya (JP); Hideki Mizutani, Kariya (JP); Kazuya Kimura, Kariya (JP); Masahiro Kawaguchi, Kariya (JP); Takeshi Imanishi, Kariya (JP); Hiroaki Kayukawa, Kariya (JP)

(73) Assignee: Kabushiki Kaisha Toyota Jidoshokki (JP)

( * ) Notice: Subject to any disclaimer, the term of this patent is extended or adjusted under 35 U.S.C. 154(b) by 18 days.

(21) Appl. No.: 09/922,399

(22) Filed: Aug. 3, 2001

(65) Prior Publication Data

US 2002/0018723 A1 Feb. 14, 2002

(30) Foreign Application Priority Data

Aug. 8, 2000 (JP) ..... 2000-239817

(51) Int. Cl.[7] ..... F04B 1/26

(52) U.S. Cl. ..... 417/222.2; 137/601.13; 137/601.14

(58) Field of Search ..... 417/222.1, 222.2; 137/601.13, 601.14

(56) References Cited

U.S. PATENT DOCUMENTS 5,890,876 A * 4/1999 Suito et al. ..... 137/907
6,352,416 B1 * 3/2002 Ota et al. ..... 417/222.2
2001/0003573 A1 * 6/2001 Kimura et al. ..... 417/222.2
2002/0004011 A1 * 1/2002 Suitou et al. ..... 417/222.2
2002/0004012 A1 * 1/2002 Kimura et al. ..... 417/222.2

FOREIGN PATENT DOCUMENTS

EP 0 993 976 A2 4/2000
JP 07-189899 7/1995
JP 2000-087848 3/2000

* cited by examiner

*Primary Examiner*—Charles G. Freay
*Assistant Examiner*—Emmanuel Sayoc
(74) *Attorney, Agent, or Firm*—Knoble & Yoshida, LLC

(57) ABSTRACT

A control valve is used in connection with a variable displacement compressor that varies the discharge capacity by controlling an inclination of a cam plate located in a crank chamber. The inclination of the cam plate is variable based on crank chamber pressure caused by refrigerant in the crank chamber. Monitor pressure is monitored at a predetermined point in a refrigerant circuit for causing a change in the crank chamber pressure and ultimately varying the discharge capacity. The control valve has a housing, an internal control valve mechanism and an external control valve mechanism. The internal control valve mechanism is located inside the valve housing and has a first valve body and a first reacting member. The first reacting member is connected to the first valve body for reacting to the monitor pressure to cause a change in the crank chamber pressure. The external control valve mechanism is located inside the valve housing and has a second valve body and a second reacting member. The second reacting member is for reacting to an external signal to cause the second valve body to change in the crank chamber pressure. The internal control valve mechanism and the external control valve mechanism operate independently with each other.

24 Claims, 3 Drawing Sheets

COMPRESSOR CONTROL VALVE WITH TWO INDEPENDENTLY OPERATED CHECK VALVES, WHEREIN THE CRANK CHAMBER PRESSURE IS THE CONTROL PRESSURE, AND THE MONITOR PRESSURE IS THE SUCTION PRESSURE

BACKGROUND OF THE INVENTION

The present invention relates to a control valve for a variable displacement compressor. More specifically, it relates to an independently controllable and compact control valve for varying the amount of discharged refrigerant gas based on internal pressure acting on a displacement control mechanism and an external signal.

A cooling circuit or a refrigerant circulation circuit is provided with a compressor for compressing refrigerant gas. Usually, when a passenger turns on an air conditioner in a vehicle, drive power is transmitted from an engine to the compressor. Automotive compressors of conventional technology are generally categorized into two types. One is with a compressibility controller which autonomously controls compression capability or an amount of refrigerant gas to be discharged corresponding to a cooling load. The other is with an electromagnetic clutch which externally controls the linkage between the compressor and the engine.

Generally, the compressibility controller has a displacement control mechanism for varying the amount of discharged refrigerant gas based on the controlling pressure and an internal control valve mechanism for controlling the controlling pressure. The controlling pressure corresponds to pressure as a cooling load such as suction pressure, that is the pressure at which refrigerant gas is drawn into the compressor. One of the displacement control mechanisms of a piston type compressor, for example, changes the inclination angle of a cam plate which converts rotational movement by an engine into reciprocating movement of a piston. The change in inclination angle of the cam plate varies the stroke distance of the piston, thereby varying the amount of discharged refrigerant gas from the compressor. One of the internal control valve mechanisms includes the pressure reacting member for sensing the fluctuation of pressure in the cooling load and a valve body for changing the opening degree of a refrigerant passage in response to the pressure reacting member so as to change the controlling pressure. In other words, movement of the pressure reacting member varies the position of the valve body to cause a change in the opening degree of the refrigerant passage ultimately in the controlling pressure.

When a cooling load demands, the compressor is connected to the vehicle engine through an electromagnetic clutch to start the compression process. During the compression, the amount of discharged refrigerant gas is controlled based on the cooling load such as suction pressure. If a passenger turns OFF the air conditioner in a vehicle, which is considered to be an external "OFF" command, the electromagnetic clutch shuts down the power transfer from the engine to the compressor, thereby shutting down the compression operation.

Nonetheless, the electromagnetic clutch in a compressor has increased the total weight of the system, manufacturing cost, and mechanical shock generated when the electromagnetic clutch is turned on. The market demanded a solution of the drawbacks and a new compressor without a clutch or a clutchless compressor which is directly connected to the compressor and the engine for vehicles so as to transmit power all the time.

To fulfill the demand for a clutchless compressor, the amount of discharged refrigerant gas is variably made to nearly nothing in response to an external command without an electromagnetic clutch. However, the ability of the internal control valve mechanism is limited to an autonomous control of the amount of discharged refrigerant gas based on a cooling load, but not on an external command.

Japanese Unexamined Patent Publication No. 2000-087848 discloses a solution by using a control valve for controlling the amount of discharged refrigerant gas from a compressor. This control valve has a valve body capable of varying an opening degree of refrigerant passage for changing the controlling pressure, a pressure reacting member capable of reacting to the cooling load, and an electromagnetic actuator capable of applying external force to the valve body. The valve body is linked to the pressure reacting member and a plunger being actuated by the electromagnetic actuator. The electromagnetic actuator is capable of applying external force to the valve body upon receipt of an external command so as to vary the opening degree of the refrigerant passage. As a result, the amount discharged of refrigerant gas is externally and independently controlled by varying the opening degree of the refrigerant passage.

On the other hand, a control valve disclosed in Japanese Unexamined Patent Publication No. 7-189899 has an internal control valve and an external control valve. The internal control valve has a valve body capable of varying an opening degree of refrigerant passage for changing the controlling pressure and a pressure reacting member capable of reacting to the cooling load, which is linked to the valve body. The external control valve has a valve body capable of varying an opening degree of refrigerant passage for changing the controlling pressure and an electromagnetic actuator capable of applying force to the valve body. The electromagnetic actuator is capable of applying force to the valve body upon receipt of an external command so as to vary the opening degree of the refrigerant passage. As a result, in this publication also the amount of discharged refrigerant gas is externally and independently controlled by varying the opening degree of the refrigerant passage. The internal control valve mechanism and the external valve control mechanism are also disposed in two separate control valve housings, and the control valve housings take a substantial portion of the rear housing space.

However, in the control valve as disclosed in Japanese Unexamined Patent Publication No. 2000-087848, a pressure reacting member and a plunger are linked to the valve body so as to move in response to the valve body. The control valve requires an apparatus varying the amount of power supply to the electromagnetic actuator for actuating the plunger and makes the construction of the control valve complex. If one tries to actuate the electromagnetic actuator without the variable power supply control apparatus, the electromagnetic actuator must be turned ON/OFF by stopping and starting the flow of electric current. This method has the following drawback. Normally, when the electromagnetic actuator is turned on by a switch, the voltage supplied to the electromagnetic actuator depends on the voltage of a battery installed in the vehicle as a power source. In other words, the external force that the electromagnetic actuator applies to the valve body is affected if a charge level of the battery supply has fluctuated. As a result, the opening degree of the refrigerant passage is affected by the fluctuation of the external force, making it difficult to control the controlling pressure depending on an opening degree of the refrigerant passage.

Furthermore, the control valve disclosed in Japanese Unexamined Patent Publication No. 7-189899, needs to manufacture two control valve housings. This increases not only assembling process, but also a space occupied by the control valve.

SUMMARY OF THE INVENTION

The object of the present invention is to offer a control valve for a variable displacement compressor and a variable displacement compressor capable of varying the amount of discharged refrigerant gas based on an autonomous change of the amount of discharged refrigerant gas from the compressor corresponding to the cooling load and based on an external command, of which construction is simplified to be compact.

To achieve the above object, the present invention has following features. A control valve is used in connection with a variable displacement compressor that varies the discharge capacity by controlling an inclination of a cam plate located in a crank chamber. The inclination of the cam plate is variable based on control pressure in a control pressure region. Monitor pressure is monitored at a predetermined point in a refrigerant circuit for causing a change in the control pressure and ultimately varying the discharge capacity. The control valve has a housing, an internal control valve mechanism and an external control valve mechanism. The internal control valve mechanism is located inside the housing and has a first valve body and a first reacting member. The first reacting member is operably connected to the first valve body for reacting to the monitor pressure to cause a change in the control pressure. The external control valve mechanism is located inside the housing and has a second valve body and a second reacting member. The second reacting member is for reacting to an external signal to cause the second valve body to change the control pressure. The internal control valve mechanism and the external control valve mechanism operate independently.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

A First Embodiment

Figure 1:
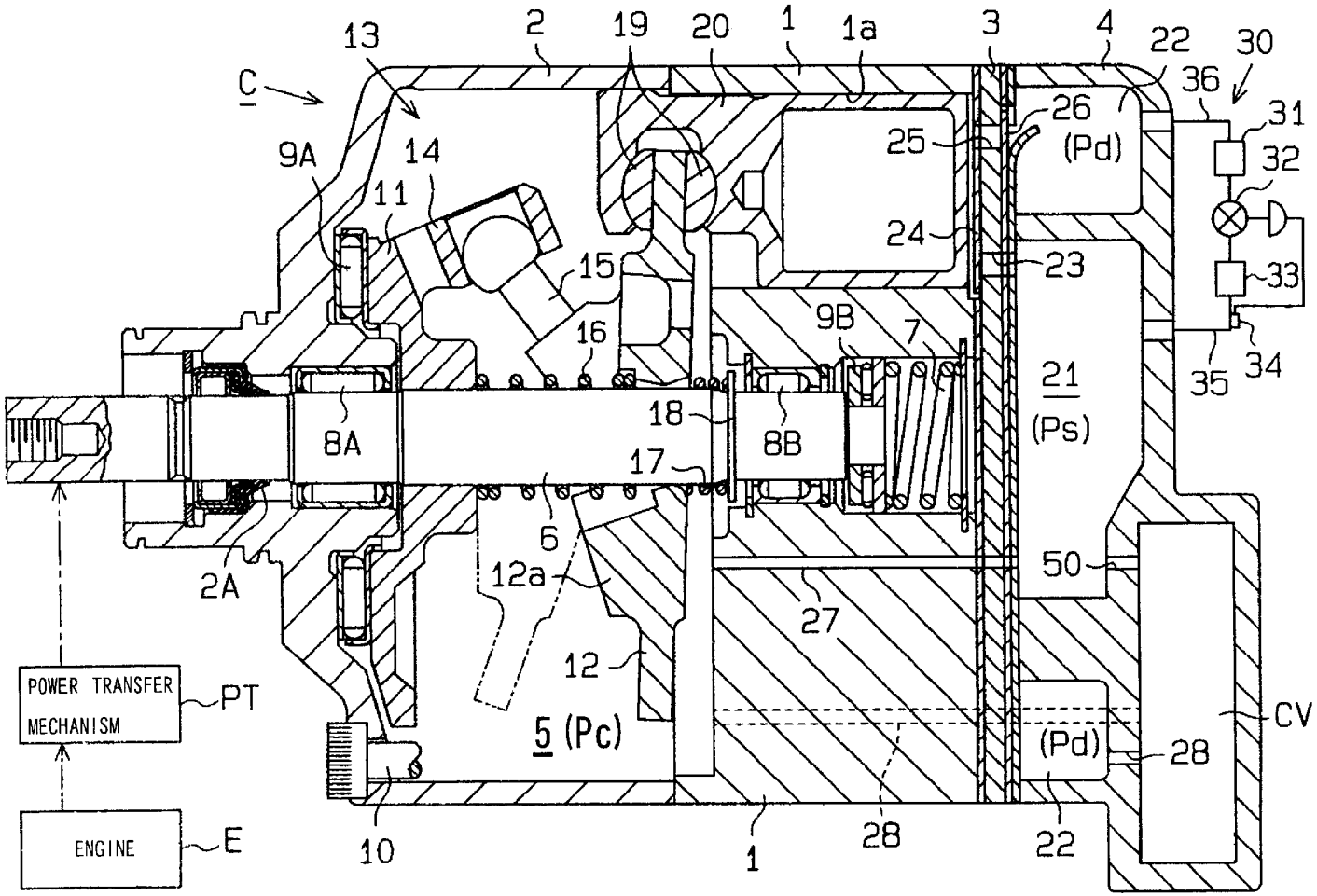
FIG. 1 is a diagram in a cross-sectional view illustrating an embodiment of the compressor C according to the present invention.

A first embodiment of the present invention is described with reference to FIGS. 1 and 2. The directional notation of "front" is left and "rear" is to the right of the drawing.

As shown in FIG. 1, a swash-plate type variable displacement compressor (hereafter referred to as "compressor") has a compressor housing and has a cylinder block 1, a front housing 2 connected to the front end of the cylinder block 1, and a rear housing 4 connected to the rear end of the cylinder block 1 through a valve plate assembly 3. The cylinder block 1, the front housing 2, the valve plate assembly 3 and the rear housing 4 are fixedly secured to each other by means of multiple through bolts 10 (only one bolt is illustrated in FIG. 1) and constitute a compressor component housing in a compressor C. A crank chamber 5 is defined between the cylinder block 1 and the front housing 2. In the crank chamber 5, a drive shaft 6 is rotatably supported by a pair of radial bearings 8A and 8B. Midway in a recess in the cylinder block 1 are provided a spring 7 and a rear end thrust bearing 9B. In the crank chamber 5, a lug plate 11 is mounted integrally with the drive shaft 6 such that the lug plate 11 and the drive shaft 6 rotate together. A front end thrust bearing 9A is provided in the space defined by the lug plate 11 and the inner wall of the front housing 2. The drive shaft 6, being integrated with the lug plate 11, is located by the rear end thrust bearing 9B urged frontward by the spring 7 and the front end thrust bearing 9A in the axial direction of the drive shaft 6. A lip seal 2A is provided toward the front end of the radial bearing 8A between the drive shaft 6 and the front housing 2. The lip seal 2A seals the gap between the drive shaft 6 and the front housing 2 to isolate the internal pressure of the compressor from the external pressure.

The front end of the drive shaft 6 is operably connected to a vehicle engine E that functions as an external driving source through power transmission mechanism PT. An exemplary power transmission mechanism PT is an ordinary transmission mechanism such as belt and pulley combination and is characterized by the lack of a clutch such as electromagnetic clutch that is capable of externally switching the ON/OFF mode.

Still referring to FIG. 1, a swash plate 12 which functions as a cam plate is housed in the crank chamber 5. The drive shaft 6 is inserted in a through hole formed in the middle of the swash plate 12. The swash plate 12 is operably connected to the lug plate 11 and the drive shaft 6 through a hinge mechanism 13, which functions as a coupling and guiding mechanism. The hinge mechanism 13 has two support arms 14 of which only one is shown in FIG. 1 and which extend from the rear surface of the lug plate 11, and two guide pins 15 of which only one is shown in FIG. 1 and which extend from the front surface of the swash plate 12. The support arms 14 are coupled with the guide pins 15, and the swash plate 12 contacts the drive shaft 6 in the central through hole. As a result, the swash plate 12 is capable of synchronized rotation with the lug plate 11 and the drive shaft 6, and of inclining with respect to the drive shaft 6 and of sliding in the axial direction of the drive shaft 6. The swash plate 12 has a counter weight 12*a* opposite to the hinge mechanism 13 with the drive shaft 6 therebetween.

A spring 16 for decreasing the inclination angle of the swash plate 12 with respect to a phantom plane perpendicular to the drive shaft 6 is attached to the drive shaft 6 between the lug plate 11 and the swash plate 12. The spring 16 pushes the swash plate 12 against cylinder block 1 in the direction in which inclination is to be decreased. A restoring spring 17 is attached to the drive shaft 6 in the space between a regulating ring 18 and the swash plate 12. When the swash plate 12 is placed at a large inclination angle as indicated in two-dotted chain lines in FIG. 1, the restoring spring 17 that is wound around drive shaft 6 does not interact with other members including the swash plate 12. However, when the swash plate 12 is at a small inclination angle as indicated with solid lines in FIG. 1, the restoring spring 17 is first compressed between the regulating ring 18 and the swash plate 12 and recoils from the cylinder block 1 to urge the swash plate 12 to increase its inclination angle.

A plurality of the cylinder bores 1*a* of which only one is shown in FIG. 1 is formed around the drive shaft 6 in the cylinder block 1, and the rear ends of the cylinder bores 1*a* are closed with the valve plate assembly 3. A single-headed piston 20 is disposed in each of the cylinder bores 1*a* respectively providing a compression chamber whose capacity is variable by reciprocating motion of the piston 20. The front end of each of the pistons 20 is engaged with the outer surface of the swash plate 12 through a pair of shoes 19. The swash plate 12 is rotated synchronously with the drive shaft 6. The rotational motion is transmitted to each of the piston 20 through the shoes 19 and is converted to linear reciprocating motion of each of the pistons 20 in a corresponding cylinder bore 1*a*.

A suction chamber 21 and a discharge chamber 22 are defined in the valve plate assembly 3 and the rear housing 4 so that the suction chamber 21 is surrounded by the discharge chamber 22. The valve plate assembly 3 is constructed with a suction valve plate, a port plate, a discharge valve plate and a retainer plate. A suction port 23, a suction valve 24 to open and close the suction port 23, a discharge port 25, and a discharge valve 26 to open and close the discharge port 25 are formed in the valve plate assembly 3. Each suction port 23, suction valve 24, discharge port 25, and discharge valve 26 correspond to one of the cylinder bores 1*a*. The suction chamber 21 communicates with each of the cylinder bores 1*a* through the suction port 23, and each of the cylinder bores 1*a* communicates with the discharge chamber 22 through the discharge port 25.

The suction chamber 21 is linked to the crank chamber 5 through a bleeding passage 27. The discharge chamber 22 is linked to the crank chamber 5 through a supply passage 28, in which a control valve CV is placed. The control valve CV adjusts control pressure in a control pressure region. In this embodiment, the crank chamber 5 defines the control pressure region, and the crank chamber pressure Pc defines the control pressure.

By adjusting the opening degree of the control valve, the amount of refrigerant fed into crank chamber 5 through the supply passage 28 is adjusted. The crank chamber pressure Pc is thus determined by the difference between the amount of high-pressure gas flowed from the supply passage 28 to the crank chamber 5 and the amount of gas bled from the crank chamber 5 through the bleeding passage 27. In other words, the supply passage 28 and the bleeding passage 27 are passages for refrigerant gas to adjust the crank chamber pressure Pc. The difference between the crank chamber pressure Pc and the pressure in the cylinder bore bores 1*a* changes by a change in the crank chamber pressure Pc. This causes to change the inclination angle of the swash plate 12 and accordingly a stroke of the piston 20. As a result, the amount of discharged refrigerant gas or refrigerant gas to be circulated is adjusted.

The maximum inclination angle of the swash plate 12 is regulated as the counterweight 12*a* of the swash plate 12 contacts the lug plate 11. The minimum inclination angle is defined by the equilibrium of the urging force of the spring 16 and the urging force of the restoring spring 17 under the condition that the difference between the crank pressure Pc and the pressure in the cylinder bore bores 1*a* through the piston 20 is nearly maximized in the direction to increase the inclination angle of the swash plate 12.

The displacement control mechanism for varying discharge capacity based on crank chamber pressure Pc is constructed with the swash plate 12, the hinge mechanism 13 including the guide pins 15. The suction chamber 21 is connected to the discharge chamber 22 through an external refrigerant circuit 30. This external refrigerant circuit 30 constitutes a refrigerant circulation circuit or a cooling circuit, and the compressor C and the refrigerant circulation circuit constitute a vehicle air conditioner system. The external refrigerant circuit 30 has a condenser 31, a thermal expansion valve 32 as a pressure reducing device and an evaporator 33. The opening degree of the thermal expansion valve 32 is controlled based on the temperature and pressure feedback from a temperature reacting pipe 34 attached toward the exit or downstream of the evaporator 33. The thermal expansion valve 32 supplies liquid refrigerant gas to the evaporator 33 to meet the cooling load and to adjust the amount of refrigerant gas circulated in the refrigerant circuit 30. A circulation pipe 35 is provided downstream in the external refrigerant circuit 30, thereby connecting the outlet of the evaporator 33 to the suction chamber 21 in the compressor. A circulation pipe 36 is upstream in the external refrigerant circuit 30 and connects the inlet of condenser 31 to the discharge chamber 22. The compressor located downstream in the external refrigerant circuit 30 draws refrigerant gas through the suction chamber 21 and compresses the gas. The compressed gas is then discharged upstream in the external refrigerant circuit 30 through the discharge chamber 22.

Figure 2:
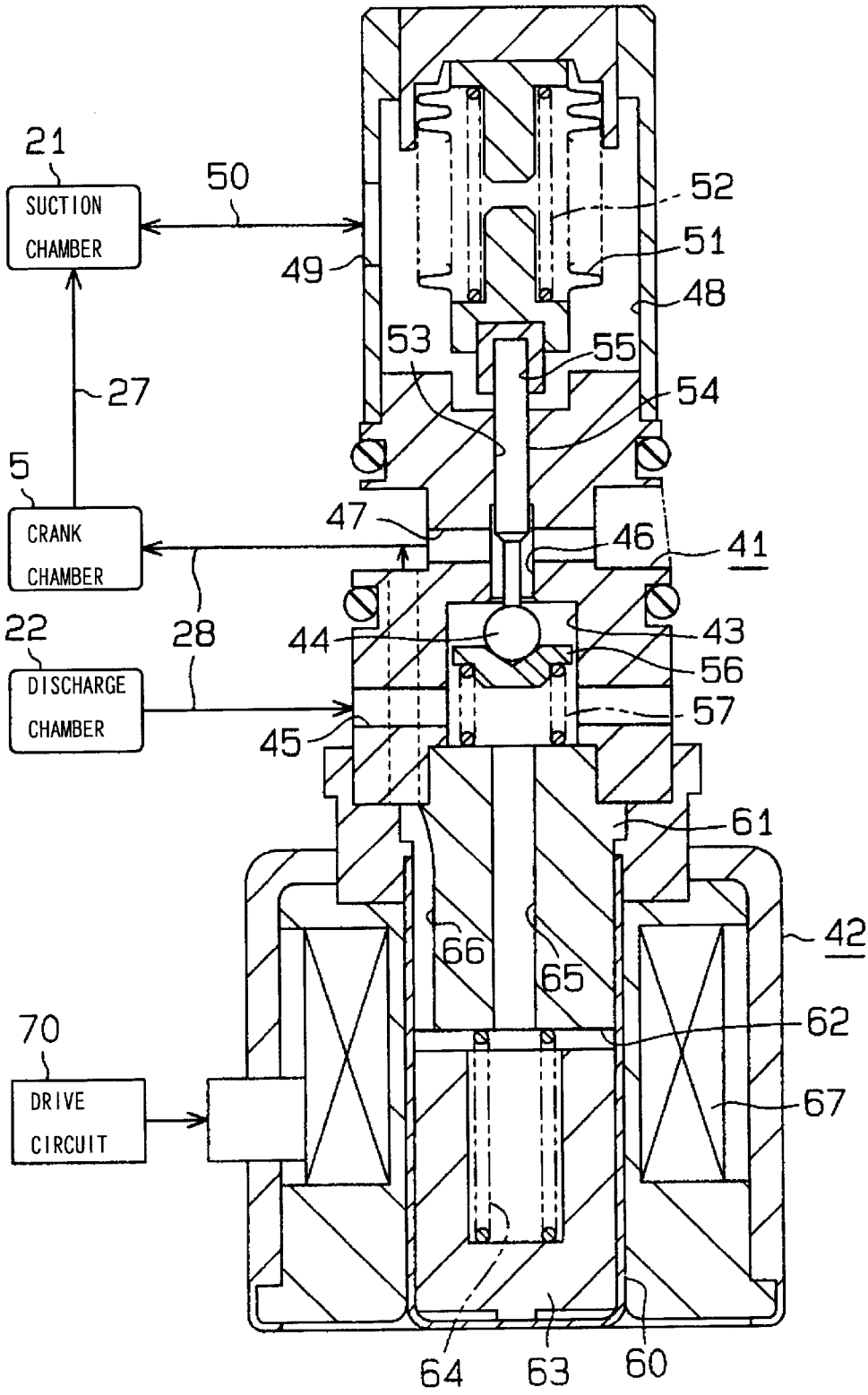
FIG. 2 is an enlarged cross-sectional view illustrating a first embodiment of a control valve CV of the compressor C as shown in FIG. 1.

The details of the control valve CV are described herein with reference to FIG. 2. The control valve CV has a control vale housing, and the control valve housing is connected to the compressor component housing thereby constituting a compressor housing. The control valve housing is integrally or detachably connected to the compressor component housing. The control valve CV has a first valve housing 41 and a second valve housing 42, which are connected to each other midway through the control valve. A first valve body 44 is movably disposed in a first valve chamber 43 that is defined by the first valve housing 41 and the second valve housing 42. The first valve chamber 43 communicates with the discharge chamber 22 in high-pressure region through a valve chamber port 45 formed on the side wall in the first valve chamber 43 and upstream in the supply passage 28.

A valve hole 46 is formed on top of the first valve chamber 43. The valve hole 46 extends in an axial direction of the first valve housing 41. A port 47 is formed above the first valve chamber 43 in the first valve housing 41. The port 47 extends in a direction perpendicular to the valve hole 46. The first valve chamber 43 communicates with the crank chamber 5 that functions as a control region through the valve hole 46, the port 47 and downstream in the supply passage 28.

A pressure sensing chamber 48 is provided above the first valve housing 41. The pressure sensing chamber 48 communicates with the suction chamber 21 through the pressure introducing port 49, which is formed on the side wall of the pressure sensing chamber 48 and a pressure introducing passage 50 in the compressor C. The suction pressure Ps in the suction chamber 21 that functions as a low pressure region and the pressure monitoring point is introduced into the pressure sensing chamber 48 through the pressure introducing port 49 and the pressure introducing passage 50. A bellows 51, the pressure responding member is provided in the pressure sensing chamber 48. A determining spring 52 determines the initial length of the bellows 51 pushing the movable end or the lower end of the bellows 51 in the expanding direction. The determining spring 52 is attached in the bellows 51. The hollow space in the bellows 51 is vacuumed or at a low pressure.

A guide hole 53 with the valve hole 46 is continuously formed midway in the first valve housing 41 between the pressure sensing chamber 48 and the first valve chamber 43. A pressure sensitive rod 54 is slidably inserted into the guide hole 53. The upper end of the pressure sensitive rod 54 is inserted into a recess 55 that is formed on the movable end of the bellows 51. The bottom end of the pressure sensitive rod 54 is secured onto the upper end of the first valve body 44. The end of the pressure sensitive rod 54 on the side of the first valve body 44 is given a smaller diameter than the inner diameter of the valve hole 46 to ensure that the refrigerant gas flow is not interrupted by the valve hole 46.

A valve seat 56 and a first coil spring 57 for pushing the valve seat 56 are provided below the first valve body 44 in the first valve chamber 43. The first coil spring 57 pushes the first valve body 44 upward through the valve seat 56. The first valve body 44 thus corresponds to the expansion/contraction of the bellows 51 as the upper end of the pressure sensitive rod 54 contacts the bottom surface of the recess 55.

The first valve body 44 is thus operably coupled with the bellows 51 through the pressure sensitive rod 54. The opening degree of the valve hole 46 is determined by the balance in the magnitude among downward urging force by the determining spring 52, upward urging force by the first coil spring 57, and urging force by the bellows 51 reflecting variation in the suction pressure Ps.

The valve chamber port 45, the first valve chamber 43, the valve hole 46, and the port 47 constitute a part of the supply passage 28. The pressure sensing chamber 48, the bellows 51, the determining spring 52, the guide hole 53, the pressure sensitive rod 54, the first valve body 44, the valve seat 56, and the first coil spring 57 constitute an autonomous internal control valve mechanism for controlling the opening degree of the supply passage 28 based on the suction pressure Ps.

The second valve housing 42 for the lower half of the control valve has an accommodation hole 60 with a bottom surface. A stationary core 61 is inserted into the upper portion of the accommodation hole 60, defining a second valve chamber 62 in the accommodation hole 60. A movable core 63 which is a cylindrical plunger with a bottom surface that functions as the second valve are disposed in the second valve chamber 62 to be reciprocated in the vertical direction. A second coil spring 64 for opening the second valve is placed between the movable core 63 and the bottom of the stationary core 61. The second coil spring 64 pushes the movable core 63 away from the stationary core 61.

A hole 65 communicates with the first valve chamber 43 and the second valve chamber 62 that are provided in the middle of the stationary core 61. The second valve chamber 62 communicates with the downstream of the supply passage 28 through a communication passage 66 that is defined in the vertical direction to extend through the outer periphery of the stationary core 61 and the lower part of the first valve housing 41. In other words, the second valve chamber 62 communicates with the discharge chamber 22 through the hole 65, the first valve chamber 43, the valve chamber port 45, and the upstream of the supply passage 28. Also, the second valve chamber 62 communicates with the crank chamber 5 through the communication passage 66 and the downstream of the supply passage 28.

A coil 67 is wound around the stationary core 61 and the movable core 63. A current flows from a drive circuit 70 to the coil 67 based on signals (not shown) received from a controller. This flow of electric current generates electromagnetic force. The movable core 63 is thus attracted to the stationary core 61 to move upward against the urging force of the second coil spring 64. When the movable core 63 contacts the stationary core 61, the communication is shut off between the hole 65 and the communication passage 66 through the second valve chamber 62. If electrical current flows from the driving circuit 70 to the coil 67 but is below a threshold value or is interrupted, the second coil spring 64 pushes the movable core 63 away from the stationary core 61 such that the hole 65 and the communication passage 66 communicate with each other through the second valve chamber 62.

The hole 65, the second valve chamber 62, the communication passage 66, the valve chamber port 45, and the first valve chamber 43 are a part of the supply passage 28. The accommodation hole 60, the stationary core 61, the movable core 63, the second coil spring 64, and the coil 67 constitute an electromagnetic actuator that moves the movable core 63 by electromagnetic force in response to a command from an external controller. These components also constitute an external control valve mechanism that externally varies the opening degree of the supply passage 28 based on a signal generated by the external controller.

The operation of the above described variable displacement compressor is described herein. When power is transmitted from the vehicle engine to the drive shaft 6 through the power transmission mechanism PT, the swash plate 12 is rotated by the drive shaft 6. The rotation of the swash plate 12 causes each of the pistons 20 in the cylinder bores 1*a* to move back and forth to generate the stroke defined by the inclination angle of the swash plate 12. In each of the cylinder bores 1*a*, the steps including suction, compression, and discharge of refrigerant gas are repeated.

If a passenger turns ON an air conditioner in a car, this is an example of a case in which a "cool" command is externally entered and the external controller commands the drive circuit 70 to send a current to the coil 67. At this time, attractive force is generated between the cores 61 and 63. This attractive force moves the movable core 63 upward until it contacts the stationary core 61 when the communication between the hole 65 and the communication passage 66 through the second valve chamber 62 is disconnected.

At this stage, the bellows 51 moves correspondingly to any change in suction pressure Ps of refrigerant gas into the pressure sensing chamber 48 through the pressure introducing passage 50. This motion of the bellows 51 is transmitted to the first valve body 44 through the pressure sensitive rod 54 thereby changing the opening degree of the valve hole 46. The monitored suction pressure Ps is regarded as being close to the pressure at the exit of the evaporator 33. The pressure at the exit of the evaporator 33 increases as the cooling load of the cooling circuit or refrigerant circulation circuit increases. In other words, the opening degree of the valve hole 46 is varied by the bellows 51 that corresponds to any change in the suction pressure Ps in the pressure sensing chamber 48 to reflect the cooling load applied to a cooling circuit.

If the cooling load in the cooling circuit is high and the suction pressure Ps is high, the pressure in the pressure sensing chamber 48 becomes high to contract the bellows 51, and the bellows 51 moves the first valve body 44 upward. When the first valve body 44 moves upward to reduce the opening degree of the valve hole 46, the amount of refrigerant gas that flows from the discharge chamber 22 into the crank chamber 5 through the supply passage 28 decreases. On the other hand, the refrigerant gas in the crank chamber 5 leaks to the suction chamber 21 through the bleeding passage 27, thereby decreasing the pressure in the crank chamber 5. The differential pressure between the crank chamber 5 and the cylinder bore bores 1*a* through the piston 20 thus decreases, and the inclination angle of the swash plate 12 increases. Consequently, the stroke of the piston 20 increases, and the amount of discharged refrigerant increases.

If the load in the cooling circuit is small and the cooling load lowers the suction pressure Ps, the pressure in the pressure sensing chamber 48 decreases to expand the bellows 51, and the bellows 51 moves the first valve body 44 downward. When the first valve body 44 moves downward, the opening degree of the valve hole 46 increases, and the amount of refrigerant gas that flows from the discharge chamber 22 into the crank chamber 5 through the supply passage 28 increases. The pressure in the crank chamber 5 is thus increased. The differential pressure between the crank chamber 5 and the cylinder bore bores 1*a* through the piston 20 increases, and the inclination angle of the swash plate 12 decreases. Consequently, the stroke of piston 20 decreases, and the amount of discharged refrigerant decreases.

As described, when a current is supplied to the coil 67 and the communication between the hole 65 and the communication passage 66 through the second valve chamber 62 stops, a control valve autonomously controls the amount of discharged refrigerant from a compressor C according to the cooling load in the cooling circuit.

If a passenger turns OFF an air conditioner in a vehicle, this is an exemplary case in which an "OFF" command is entered from an external device. The controller commands the drive circuit 70 to stop the current flow to the coil 67. When there is no current flowing into the coil 67, no attractive force is generated between the cores 61 and 63, and the movable core 63 is pushed downward by the second coil spring 64 until it reaches the bottom of the accommodation hole 60. The hole 65 and the communication passage 66 through the second valve chamber 62 are thus communicated. In this communicating stage, as refrigerant gas flows from the discharge chamber 22 to the crank chamber 5 through the valve hole 46, additional refrigerant gas flows from the discharge chamber 22 into the crank chamber 5 through the hole 65, the second valve chamber 62, and the communication passage 66. If the crank pressure Pc becomes very high, the differential pressure between the crank chamber 5 and the cylinder bore bores 1*a* through the piston 20 is significantly increased, and the inclination angle of the swash plate 12 is minimized. Consequently, the stroke of the piston 20 is minimized to discharge minimum amount of refrigerant gas.

Embodiments of the present invention and the various advantages of the present invention are described herein.

(1) The preferred embodiments according to the present invention provide (a) an internal control valve mechanism which autonomously controls the opening degree of the supply passage 28 based on the suction pressure and (b) an external control valve mechanism that externally controls the opening degree of the supply passage 28 based on a signal generated by an external controller. The amount of discharged refrigerant gas from a compressor is controlled not only by the internal control valve mechanism but also by entering a command from an external device. If an emergency situation demands, the amount of discharged refrigerant from the compressor is significantly and rapidly changed regardless of the cooling load, and the amount of the torque required for driving the compressor is quickly changed. In summary, the control valve of the present invention is excellent under normal circumstances in which room temperature is maintained. It is also excellent in accommodating an emergency situation in which the discharge capacity of the compressor is rapidly minimized to be almost zero and the like.

(2) The motion of the first valve body 44 for changing the opening degree of the supply passage 28 through the valve hole 46 is independent of the motion of the movable core 63 for changing the opening degree of the supply passage 28 through the second valve chamber 62. This makes the movable core 63 to function as the second valve body independent from the first valve body 44, which is continuously operating according to the suction pressure Ps that is detected at the pressure monitoring point. As a result, the control valve according to the present invention autonomously controls the amount of refrigerant gas to be discharged by the internal control valve mechanism. At the same time, the control valve according to the present invention externally controls the amount of refrigerant gas to be discharged by way of processing a command entered from an external device without conflict.

If a vehicle battery is the power source for the coil 67, a fluctuation of the charge level of the vehicle battery affects a constant current flow to the coil 67. Japanese Unexamined Patent Publication No. 2000-087848 discloses an example in which an actuator excited by electromagnetic force from a coil and a valve body which changes the opening degree of the supply passage are affected by a fluctuation of the supply battery. In this case, the valve body is unable to accurately change the opening degree of the supply passage 28. In the control valve of the present invention, the first valve body 44 and the movable core 63 are not linked to each other. The amount of discharged refrigerant gas from the compressor, therefore, is controlled based on the cooling load in a cooling circuit without being affected by any fluctuation of battery voltage. In other words, the internal control valve mechanism of the control valve of the present invention controls the amount of discharged refrigerant gas from the compressor according to the cooling load in the cooling circuit, even if it is difficult to maintain the constant electric current flow to the external control valve mechanism. For this reason, a compressor having an electromagnetic clutch may be replaced with the compressor of the present invention, and the harness used for supplying current to the electromagnetic clutch may be connected to a control valve.

(3) The internal control valve mechanism and the external control valve mechanism is constructed with the first and the second valve housings 41 and 42 in a common housing. As compared to a configuration in which the two control valve mechanisms are housed in separate housing units, the single housing reduces the number of passages such as supply passage 28 linking each of the control valve mechanisms, the discharge chamber 22, and the crank chamber 5, thereby simplifying manufacturing steps.

(4) The valve chamber port 45 and the first valve chamber 43 constituting a part of the supply passage 28 are a common refrigerant gas passage for the internal control valve mechanism and the external control valve mechanism. Compared to the configuration in which the two control valve mechanisms do not share a common refrigerant gas passage, the number of manufacturing steps required for refrigerant gas passages in the control valve housing is reduced, further simplifying the manufacturing steps of the compressor.

(5) The pressure in the suction chamber 21 or the suction pressure Ps is introduced to the pressure sensing chamber 48, and the bellows 51 moves correspondingly to the suction pressure Ps therein. In other words, a pressure monitoring point for the internal control valve mechanism is located in the low pressure region including the evaporator 33 and the suction chamber 21 constituting a cooling circuit or refrigerant circulation circuit. The low pressure in the region reflects the cooling load of the cooling circuit. As a result, the internal control valve mechanism controls the amount of discharged refrigerant gas from the compressor to accommodate the cooling load.

(6) The two valve bodies or the first valve body 44 and the movable core 63 change the opening degree of the supply passage 28 to eventually change the crank pressure Pc and the discharge capacity of the compressor. In other words, the crank pressure Pc is changed by changing the amount of refrigerant gas led into the crank chamber 5 from the high-pressure region between the condenser 31 and the discharge chamber 22 of the compressor constituting a cooling circuit or refrigerant circulation circuit. Since the pressure in the high-pressure region is higher than the crank pressure Pc, the crank pressure Pc is responsively adjusted.

(7) The electromagnetic force generated by the coil 67 moves the movable core 63 that functions as the second valve body. In this way, the amount of discharged refrigerant gas from the compressor is changed by an electrical signal entered from an external device.

(8) When there is no current flowing into the coil 67, the movable core 63 moves in a direction in which the amount of discharged refrigerant gas from the compressor is reduced. In this configuration, even if the electromagnetic actuator does not operate due to power outage etc., the crank pressure Pc is induced such that the amount of discharged refrigerant gas from the compressor is reduced. In other words, the torque in the compressor is minimized or is zero. As a result, the variable displacement compressor provides improved safety under a state of emergency.

(9) Current flows from the drive circuit 70 to the coil 67 based on two following states. In the "ON" state, the movable core 63 contacts the stationary core 61, and in the "OFF" state, the movable core 63 does not contact the stationary core 61. In other words, the electromagnetic actuator is turned ON/OFF on a binary basis to simplify the structure of the power supply components such as the controller and the drive circuit 70 of the electromagnetic actuator. For example, for vehicles, the compressor of conventional technology in which an electromagnetic clutch is turned ON/OFF on a binary basis by driving power source, may be replaced with the compressor of the present invention. In this case, the controller and the driving apparatus previously used for supplying power to the electromagnetic clutch is now utilized for driving the electromagnetic actuator of the control valve in the compressor of the present invention.

(10) In the present invention, the second valve body which continues or shuts off the communication between the communication passage 66 and the hole 65 through the second valve chamber 62, is the movable core 63 itself which is actuated by the electromagnetic force generated by the coil 67. Compared with a configuration that a valve body for continuing communication between the hole 65 and the communication passage 66 through the second valve chamber 62 is independently provided, the present invention provides a simple control valve mechanism structure to enable miniaturization of the second valve housing 42 and the control valve.

The present invention is not limited to the above embodiments and can be modified as follows. As shown in FIGS. 1 and 2, in the control valve housing, the first valve body 44 and the movable core 63 have different refrigerant gas passages which are not commonly shared. The pressure in the circulation pipe 35 or near the exit of the evaporator 33 is introduced to the pressure sensing chamber 48. through a pressure introducing passage 50. Any pressure other than the low-pressure region defined by the evaporator 33 and the suction chamber 21 is introduced to the pressure sensing chamber 48. For example, the pressure in the high-pressure region defined by the discharge chamber 22 and the condenser 31 is introduced to the pressure sensing chamber 48 through a pressure introducing passage 50. In the above embodiment, the upstream of the supply passage 28 being communicated with the discharge chamber 22 is connected to the valve chamber port 45 in the control valve, and the downstream of the supply passage 28 being communicated to the crank chamber 5 is connected to the port 47. Instead, the downstream of the supply passage 28 is connected to the valve chamber port 45, and the upstream of the supply passage 28 is connected to the port 47. In this case, the communication passage 66 is defined such that it communicates with the upstream of the supply passage 28 and with the second valve chamber 62. The control valve housing is integrally formed with the compressor component housing. The control valve housing is formed separate from the compressor component housing, although this construction is not illustrated. The internal control valve mechanism is located inside the first control valve housing, and the external control valve mechanism is located inside the second control valve housing. Both the internal control valve mechanism and the external control valve mechanism are located inside either the first control valve housing or the second control valve housing.

A Second Embodiment

Figure 3:
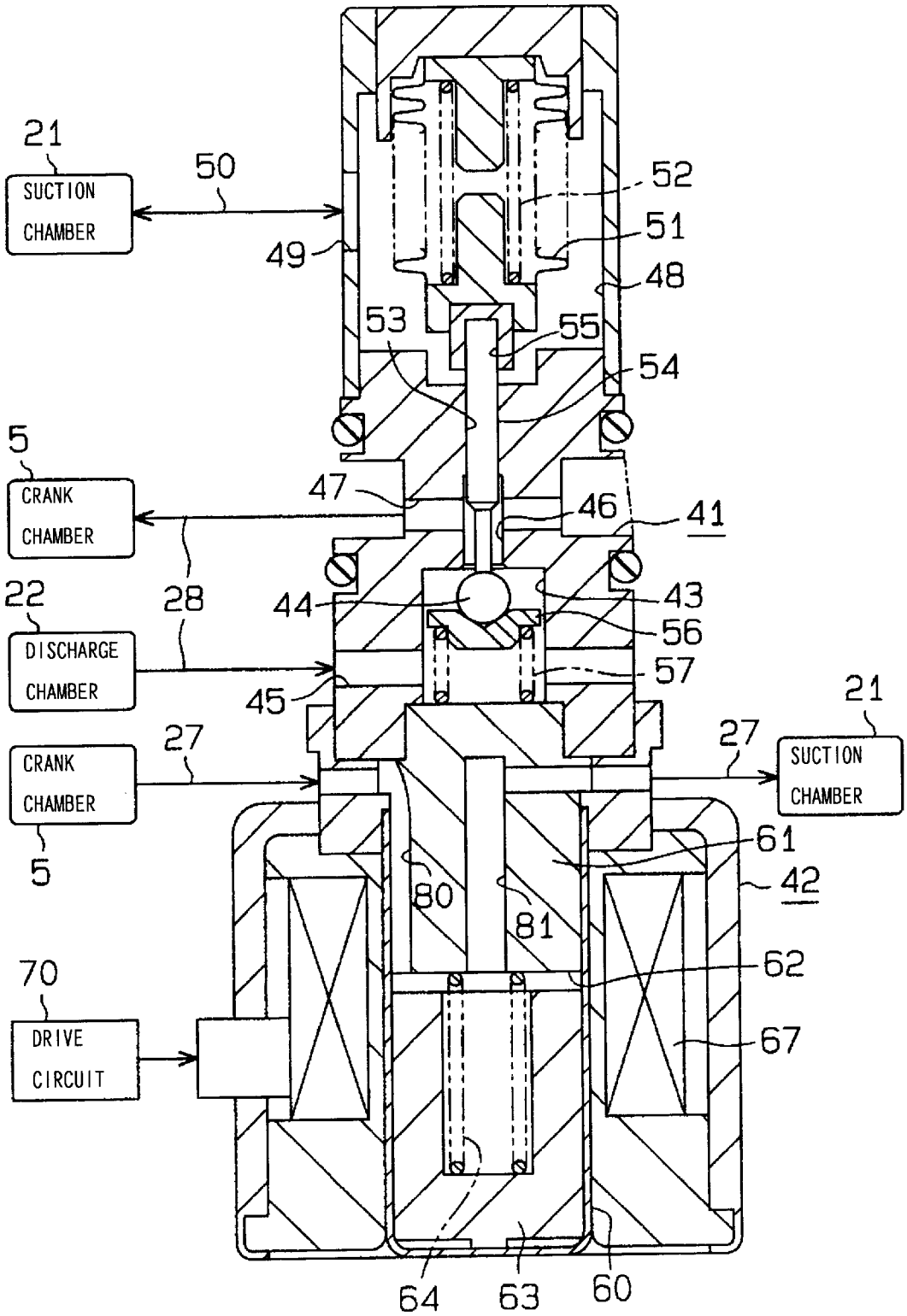
FIG. 3 is an enlarged cross-sectional view illustrating a second embodiment of another control valve CV of the compressor C as shown in FIG. 1.

As shown in FIGS. 1 and 3, the opening degree is changed for the bleeding passage 27 instead of the supply passage 28 by the movable core 63 that functions as the second valve body. In this constitution, the hole 65, through which the first valve chamber 43 communicates with the second valve chamber 62 and the communication passage 66, through which the downstream of the supply passage 28 communicates with the second valve chamber 62 according to the first embodiment are both eliminated. Instead, a communication passage 80, which connects the second valve chamber 62 and the upstream side of the bleeding passage 27 to the control valve, and a communication passage 81, which connects the second valve chamber 62 and the downstream side of the bleeding passage 27 to the control valve are provided. The communication between the communication passages 80 and 81 through the second valve chamber 62 is maintained or interrupted based on the location of the movable core 63. In this case, when a current does not flow to the coil 67, the bleeding passage 27 is in a communicating state, and the amount of discharged refrigerant gas from the compressor is autonomously controlled by changing the opening degree of the supply passage 28 utilizing the bellows 51 or the first valve body 44. When a current flows to the coil 67, the bleeding passage 27 is shut, and the refrigerant gas flowing from the crank chamber 5 to the suction chamber 21 is shut, and the refrigerant gas to flow from the discharge chamber 22 through the supply passage 28 to the crank chamber 5 causes the crank pressure Pc to increase. This high crank chamber pressure Pc reduces the inclination angle of the swash plate 12 and decreases the amount of discharged refrigerant gas from the compressor.

The above embodiment can be modified as follows. The first valve body 44 used for changing the opening degree of the supply passage 28 is used for changing opening degree of the bleeding passage 27. In such a case, when the cooling load is increased and the suction pressure Ps is introduced into the pressure sensing chamber 48, the first valve body 44 is arranged to increase the opening degree of the bleeding passage 27 to decrease the crank chamber pressure Pc and to increase the amount of discharged refrigerant gas. The movable core 63 moves in a direction in which the amount of discharged refrigerant gas is reduced when the coil 67 is turned on. The electromagnetic actuator is not controlled on a binary ON/OFF basis. For example, when the coil 67 is turned ON, a current flows at a constant magnitude or at many different magnitudes. The second valve body for controlling the communication between the hole 65 and the communication passage 66 through the second valve chamber 62 is formed independently from the movable core 63 moved by electromagnetic force generated by the coil 67. The second valve body is a hydraulic component and thus is not moved by electrical signals entered from an external device or a computer. The variable displacement compressor in which a cam plate (the swash plate 12) is integrally rotated with the drive shaft 6 is of a "wobble" type in which a cam plate is supported such that it rotates around the drive shaft and oscillates thereon. Any control valve mechanism is accepted as far as a compressor has a displacement control mechanism capable of varying the amount of discharged refrigerant gas based on the pressure used for controlling the displacement control mechanism. Thus, it is not essential to be a "wobble" type in which a cam plate rotates around the drive shaft and oscillates thereon.

As described above, in a control valve for use in a variable displacement compressor and the variable displacement compressor according to the present invention, the amount of discharged refrigerant from a compressor is autonomously controlled based on the cooling load and the amount of discharged refrigerant from a compressor is controlled based on a command from an external device, and those construction is simplified.

The present examples and embodiments are to be considered as illustrative and not restrictive and the invention is not to be limited to the details given herein but may be modified within the scope of the appended claims.

What is claimed is:

1. A control valve used in connection with a variable displacement compressor that varies the discharge capacity by controlling an inclination of a cam plate located in a crank chamber, the inclination of the cam plate being variable based on control pressure in a control pressure region, monitor pressure being monitored at a predetermined point in a refrigerant circuit for causing a change in the control pressure and ultimately varying the discharge capacity, said control valve comprising:

a housing;

an internal control valve mechanism located inside said housing having a first valve body and a first reacting member, the first reacting member operably connected to the first valve body for reacting to the monitor pressure to cause a change in the control pressure; and an external control valve mechanism located inside said housing having a second valve body and a second reacting member, the second reacting member for reacting to an external signal to cause the second valve body to change the control pressure, wherein said internal control valve mechanism and said external control valve mechanism operate independently.

2. The control valve according to claim 1 wherein the control pressure is crank chamber pressure, and wherein the monitor pressure is suction pressure.

3. The control valve according to claim 2 further comprising a passage for connecting at least the predetermined point to the crank chamber for passing the refrigerant.

4. The control valve according to claim 3 wherein said internal control valve mechanism and said external control valve mechanism share a part of said passage.

5. The control valve according to claim 1 further comprising ports formed in said housing for passing the refrigerant, wherein said internal control valve mechanism and said external control valve mechanism share one of said ports.

6. The control valve according to claim 1 wherein the second reacting member is an electromagnetic actuator and the second valve body is a plunger operated by the electromagnetic actuator based on the external signal.

7. The control valve according to claim 6 wherein the plunger is operated so that the crank chamber pressure increases while the electromagnetic actuator is turned off.

8. The control valve according to claim 6 wherein the electromagnetic actuator is a coil and the plunger is a movable core.

9. The control valve according to claim 8 further comprising a stationary core whose bottom surface is a seat of the movable core.

10. The control valve according to claim 1 wherein said housing is a control valve housing.

11. The control valve according to claim 1 wherein the control pressure is crank chamber pressure, and wherein the monitor pressure is discharge pressure.

12. A variable displacement compressor comprising:

a compressor housing forming a crank chamber;

a predetermined point in a refrigerant circuit;

a compression mechanism located inside said compressor housing for compressing refrigerant and discharging the compressed refrigerant;

a displacement control mechanism located inside said compressor housing having a cam plate in the crank chamber for varying discharge capacity by controlling an inclination of the cam plate;

a control valve mechanism in connection with the compressor housing for controlling control pressure in a control pressure region, said control valve mechanism further comprising;

an internal control valve mechanism located inside said compressor housing having a first valve body and a first reacting member for reacting to monitor pressure being monitored at the predetermined point connected to the first valve body to cause a change in the control pressure; and an external control valve mechanism located inside said compressor housing having a second valve body and a second reacting member for reacting to an external signal to cause the second valve body to change in the control pressure, wherein the internal control valve mechanism and the external control valve mechanism operate independently.

13. The variable displacement compressor according to claim 12 wherein the control pressure is crank chamber pressure, and wherein the monitor pressure is suction pressure.

14. The variable displacement compressor according to claim 12 wherein said compressor housing further comprises a compressor component housing and a control valve housing, said compression mechanism and said displacement control mechanism being located inside the compressor component housing, said control valve mechanism being located in the control valve housing.

15. The variable displacement compressor according to claim 14 wherein the control valve housing further comprises a first control valve housing and a second control valve housing, the internal control valve mechanism being located inside the first control valve housing, the external control valve mechanism being located inside the second control valve housing.

16. The variable displacement compressor according to claim 14 wherein the control valve housing further comprises a first control valve housing and a second control valve housing, the internal control valve mechanism and the external control valve mechanism being located inside the first control valve housing.

17. The variable displacement compressor according to claim 14 wherein the compressor component housing is integrally formed with the control valve housing.

18. The variable displacement compressor according to claim 14 wherein the control valve housing is detachably connected to the compressor component housing.

19. The variable displacement compressor according to claim 12 wherein the cam plate is a swash plate and said variable displacement compressor is a swash plate type variable displacement compressor.

20. The variable displacement compressor according to claim 12 wherein the cam plate is a wobble plate and said variable displacement compressor is a wobble plate type variable displacement compressor.

21. The variable displacement compressor according to claim 12 wherein said compressor housing forms a suction chamber, said compressor being used in connection with an evaporator, the predetermined point for the monitor pressure being between the suction chamber and the evaporator.

22. The variable displacement compressor according to claim 12 wherein said compressor housing forms a discharge chamber, said compressor being used in connection with a condenser, the predetermined point for the monitor pressure being between the discharge chamber and the condenser.

23. The variable displacement compressor according to claim 12 wherein said compressor housing forms a discharge chamber and a control pressure region, said compressor being used in connection with a condenser, the control pressure region communicating with a region between the discharge chamber and the condenser through a supply passage in the refrigerant circuit, the first valve body adjusting an opening degree of the supply passage.

24. The variable displacement compressor according to claim 12 wherein said compressor housing forms a discharge chamber and a control pressure region, said compressor being used in connection with a condenser, the control pressure region communicating with a region between the discharge chamber and the condenser through a supply passage in the refrigerant circuit, the second valve body adjusting an opening degree of the supply passage.

* * * * *